US010959308B2

(12) United States Patent
Shao

(10) Patent No.: US 10,959,308 B2
(45) Date of Patent: Mar. 23, 2021

(54) PARALLEL CIRCUIT FOR LIGHT-EMITTING DIODES

(71) Applicant: BLOOMING INTERNATIONAL LIMITED, British West Indies (AI)

(72) Inventor: Shu-Fa Shao, Taipei (TW)

(73) Assignee: Blooming International Limited, British West Indies (AI)

( * ) Notice: Subject to any disclaimer, the term of this patent is extended or adjusted under 35 U.S.C. 154(b) by 0 days.

(21) Appl. No.: 16/405,824

(22) Filed: May 7, 2019

(65) Prior Publication Data

US 2020/0236746 A1 Jul. 23, 2020

(30) Foreign Application Priority Data

Jan. 21, 2019 (CN) ..... 201910052814.2

(51) Int. Cl.
*H05B 45/46* (2020.01)
*F21V 23/00* (2015.01)
(Continued)

(52) U.S. Cl.
CPC ..... *H05B 45/46* (2020.01); *F21S 4/10* (2016.01); *F21V 23/001* (2013.01);
(Continued)

(58) Field of Classification Search
CPC .... F21V 23/003; F21V 23/04; F21V 23/0407; H05B 33/0842; F21Y 2115/10
(Continued)

(56) References Cited

U.S. PATENT DOCUMENTS 2,201,045 A 5/1940 Lundstrom
2,857,506 A 10/1958 Minteer
(Continued)

FOREIGN PATENT DOCUMENTS

CA 2 655 486 A1 9/2009
CN 200982547 Y 11/2007
(Continued)

OTHER PUBLICATIONS

Advancement International, Standard Wire and Solid Wire, https://mechanicallugs.com/index.php.standed-vs-solid; Jan. 19, 2016.
(Continued)

*Primary Examiner* — Raymond R Chai
(74) *Attorney, Agent, or Firm* — Christensen, Fonder, Dardi & Herbert PLLC

(57) ABSTRACT

A parallel circuit for light-emitting diodes includes a first power wire, a second power wire, a first LED, a second LED, a switch, and a controller. The first LED has two ends respectively connected to the first power wire and the second power wire. The second LED and the switch are serially connected into a series circuit. One end of the series circuit is connected to the first power wire, and the other end of the series circuit is connected to the second power wire. The switch changes between a conductive state and a non-conductive state according to a switching frequency. The controller is electrically connected to the first power wire and the second power wire. The controller supplies electric power to the first power wire and the second power wire, to generate a voltage difference between the first power wire and the second power wire.

25 Claims, 5 Drawing Sheets

(51) Int. Cl.

| | |
|---|---|
| ***F21S 4/10*** | (2016.01) |
| ***F21V 23/04*** | (2006.01) |
| ***H05B 45/10*** | (2020.01) |
| ***F21Y 115/10*** | (2016.01) |
| ***H05B 45/00*** | (2020.01) |

(52) U.S. Cl.
CPC ..... *F21V 23/003* (2013.01); *F21V 23/04* (2013.01); *F21V 23/0407* (2013.01); *H05B 45/10* (2020.01); *F21Y 2115/10* (2016.08); *H05B 45/00* (2020.01)

(58) Field of Classification Search
USPC ..... 315/185 R, 291
See application file for complete search history.

(56) References Cited

U.S. PATENT DOCUMENTS

| | | | |
|---|---|---|---|
| 3,603,780 | A | 9/1971 | Lu |
| 3,617,732 | A | 11/1971 | Fisher |
| 3,970,834 | A | 7/1976 | Smith |
| 3,985,924 | A | 10/1976 | Pritza |
| 4,020,201 | A | 4/1977 | Miller |
| 4,140,823 | A | 2/1979 | Weskamp |
| 4,161,768 | A | 7/1979 | Caverzan |
| 4,675,575 | A | 6/1987 | Smith et al. |
| 4,761,720 | A | 8/1988 | Solow |
| 4,812,956 | A | 3/1989 | Chen |
| 4,870,547 | A | 9/1989 | Crucefix |
| 4,908,743 | A | 3/1990 | Miller |
| 5,015,510 | A | 5/1991 | Smith |
| 5,091,834 | A | 2/1992 | Kao et al. |
| 5,109,324 | A | 4/1992 | Ahroni |
| 5,150,964 | A | 9/1992 | Tsui |
| 5,245,519 | A | 9/1993 | Openiano |
| 5,311,417 | A | 5/1994 | Heh |
| 5,609,412 | A | 3/1997 | Contigiani |
| 5,700,081 | A | 12/1997 | Mengle et al. |
| 5,747,940 | A | 5/1998 | Openiano |
| 5,776,559 | A | 7/1998 | Woolford |
| 5,834,901 | A | 11/1998 | Shen |
| 5,839,819 | A | 11/1998 | Pan |
| 5,855,705 | A | 1/1999 | Gauthier |
| 5,860,731 | A | 1/1999 | Martinez |
| 5,884,125 | A | 3/1999 | Taniguchi |
| 5,975,717 | A | 11/1999 | Rahman |
| 6,042,418 | A | 3/2000 | Cummings |
| 6,086,221 | A | 7/2000 | Wu |
| 6,086,222 | A | 7/2000 | Juba |
| 6,091,204 | A | 7/2000 | Chen |
| 6,152,576 | A | 11/2000 | Mount |
| 6,273,584 | B1 | 8/2001 | Wang |
| 6,309,087 | B1 | 10/2001 | Huang et al. |
| 6,347,965 | B1 | 2/2002 | Pan |
| 6,354,719 | B1 | 3/2002 | Pan |
| 6,367,952 | B1 | 4/2002 | Giboney, Jr. |
| 6,582,094 | B2 | 6/2003 | Liu |
| 6,592,238 | B2 | 7/2003 | Cleaver et al. |
| 6,604,841 | B2 | 8/2003 | Liu |
| 6,609,814 | B2 | 8/2003 | Ahroni |
| 6,652,927 | B1 | 11/2003 | Chen |
| 6,758,001 | B1 | 7/2004 | Su |
| 6,769,954 | B2 | 8/2004 | Su |
| 6,777,891 | B2 | 8/2004 | Lys et al. |
| 6,883,951 | B2 | 4/2005 | Wu |
| 6,908,215 | B2 | 6/2005 | Wu |
| 6,914,194 | B2 | 7/2005 | Fan |
| 6,974,227 | B2 | 12/2005 | Tsai |
| 7,052,156 | B2 | 5/2006 | Primeau |
| 7,062,442 | B2 | 6/2006 | Sugar |
| 7,088,904 | B2 | 8/2006 | Ryan, Jr. |
| 7,131,748 | B2 | 11/2006 | Kazar et al. |
| 7,152,998 | B2 | 12/2006 | Rahman |
| 7,160,140 | B1 | 1/2007 | Mrakovich et al. |
| 7,186,005 | B2 | 3/2007 | Hulse |
| 7,235,815 | B2 | 6/2007 | Wang |
| 7,250,730 | B1 | 7/2007 | Allen |
| 7,253,566 | B2 | 8/2007 | Lys et al. |
| 7,445,824 | B2 | 11/2008 | Leung et al. |
| 7,481,555 | B2 | 1/2009 | Huang et al. |
| 7,494,244 | B1 | 2/2009 | Van Diep |
| 7,554,266 | B1 | 6/2009 | Chen |
| 7,569,996 | B2 | 8/2009 | Holmes |
| 7,661,847 | B2 | 2/2010 | Wang |
| 7,726,829 | B2 | 6/2010 | Stuhr |
| 7,784,961 | B1 | 8/2010 | Rawlings |
| D623,084 | S | 9/2010 | Chen et al. |
| 7,926,978 | B2 | 4/2011 | Tsai |
| 7,976,191 | B2 | 7/2011 | Gibboney |
| 8,016,440 | B2 | 9/2011 | Yu |
| 8,076,872 | B2 * | 12/2011 | Sauerlander ..... H05B 45/00 315/362 |
| 8,203,275 | B2 * | 6/2012 | Ruxton ..... H05B 33/0824 315/185 R |
| 8,309,188 | B2 | 11/2012 | Cheng |
| 8,397,381 | B2 | 3/2013 | Tsai |
| 8,454,186 | B2 | 6/2013 | Chen |
| 8,454,187 | B2 | 6/2013 | Chen |
| 8,469,734 | B2 | 6/2013 | Chen |
| 8,469,750 | B2 | 6/2013 | Chen |
| 8,480,278 | B2 | 7/2013 | Wasem |
| 8,562,175 | B2 | 10/2013 | Chen |
| 8,568,015 | B2 | 10/2013 | Chen |
| 8,569,960 | B2 | 10/2013 | Chen |
| 8,592,845 | B2 | 11/2013 | Chen |
| 8,598,805 | B2 * | 12/2013 | Tremblay ..... F21V 23/005 315/291 |
| 8,608,342 | B2 | 12/2013 | Chen |
| 8,622,576 | B2 | 1/2014 | Zhan |
| 8,641,229 | B2 | 2/2014 | Li |
| 8,678,615 | B1 | 3/2014 | Ko |
| 8,680,773 | B2 | 3/2014 | Hering et al. |
| 8,870,404 | B1 | 10/2014 | Chen |
| 8,876,321 | B2 | 11/2014 | Chen |
| 8,974,072 | B2 | 3/2015 | Chen |
| 9,044,056 | B2 | 6/2015 | Chen |
| 9,055,777 | B2 | 6/2015 | Chen |
| 9,066,617 | B2 | 6/2015 | Chen |
| 9,119,495 | B2 | 9/2015 | Leung et al. |
| 9,140,438 | B2 | 9/2015 | Chen |
| 9,157,587 | B2 | 10/2015 | Chen |
| 9,179,793 | B2 | 11/2015 | Chen |
| 9,220,361 | B1 | 12/2015 | Chen |
| 9,222,656 | B2 | 12/2015 | Chen |
| 9,243,788 | B2 | 1/2016 | Chen |
| 9,279,551 | B2 | 3/2016 | Vissenberg et al. |
| 9,291,318 | B1 | 3/2016 | Benson |
| 9,386,652 | B1 | 7/2016 | Lee |
| 9,439,528 | B2 | 9/2016 | Chen |
| 9,441,800 | B1 | 9/2016 | Chen |
| 9,441,823 | B1 | 9/2016 | Chen |
| 9,468,062 | B2 | 10/2016 | Rybicki |
| 9,526,286 | B2 | 12/2016 | Chen |
| 9,572,446 | B2 | 2/2017 | Chen |
| 9,593,831 | B2 | 3/2017 | Yu |
| 9,763,298 | B2 | 3/2017 | Weeks, Jr. et al. |
| 9,655,211 | B2 | 5/2017 | Altamura et al. |
| 9,671,097 | B2 | 6/2017 | Chen |
| 9,677,748 | B1 | 6/2017 | Chen |
| 9,677,749 | B2 | 6/2017 | Chen |
| 9,752,771 | B2 | 9/2017 | Loos |
| 9,788,384 | B1 | 10/2017 | Harris |
| 9,845,925 | B2 | 12/2017 | Chen |
| 9,883,556 | B2 | 1/2018 | Chen |
| 9,907,136 | B2 | 2/2018 | Leung et al. |
| 9,939,117 | B1 | 4/2018 | Peng |
| 10,006,596 | B2 | 6/2018 | Yu et al. |
| 10,123,387 | B2 | 11/2018 | Lai |
| 10,136,497 | B2 | 11/2018 | Harris |
| 10,184,654 | B1 | 1/2019 | Chen |
| 10,205,073 | B2 | 2/2019 | Altamura |
| 10,288,235 | B1 | 5/2019 | Chen |
| 10,288,236 | B1 | 5/2019 | Chen |
| 10,578,260 | B1 | 3/2020 | Chen |

(56) References Cited

U.S. PATENT DOCUMENTS

| | | | | |
|---|---|---|---|---|
| 10,624,166 | B1 | 4/2020 | Shao | |
| 2002/0027778 | A1 | 3/2002 | Ko | |
| 2002/0097573 | A1 | 7/2002 | Shen | |
| 2003/0063463 | A1 | 4/2003 | Sloan et al. | |
| 2004/0012950 | A1 | 1/2004 | Pan | |
| 2004/0080281 | A1 | 4/2004 | Pan | |
| 2004/0090770 | A1 | 5/2004 | Primeau | |
| 2004/0096596 | A1 | 5/2004 | Palmer, III et al. | |
| 2004/0246718 | A1 | 12/2004 | Fan | |
| 2005/0047136 | A1 | 3/2005 | Fan | |
| 2005/0174065 | A1 | 8/2005 | Janning | |
| 2005/0249892 | A1 | 11/2005 | Rocheleau | |
| 2006/0158878 | A1 | 7/2006 | Howell | |
| 2006/0221609 | A1 | 10/2006 | Ryan, Jr. | |
| 2007/0015396 | A1 | 1/2007 | Mrakovich et al. | |
| 2007/0177402 | A1 | 8/2007 | Wu | |
| 2007/0230174 | A1 | 10/2007 | Hicks | |
| 2007/0262725 | A1 | 11/2007 | Koren | |
| 2008/0049424 | A1 | 2/2008 | Wang | |
| 2008/0084695 | A1 | 4/2008 | Hsu | |
| 2008/0084702 | A1 | 4/2008 | Cheung | |
| 2008/0094828 | A1 | 4/2008 | Shao | |
| 2008/0218092 | A1 | 9/2008 | Chang et al. | |
| 2009/0154156 | A1 | 6/2009 | Lo et al. | |
| 2009/0302771 | A1 | 12/2009 | Peng | |
| 2010/0001664 | A1 | 1/2010 | Shih | |
| 2010/0072747 | A1 | 3/2010 | Krize | |
| 2010/0141161 | A1 | 6/2010 | Hering et al. | |
| 2010/0157598 | A1 | 6/2010 | Tsai | |
| 2010/0277084 | A1* | 11/2010 | Lee | H05B 33/0806 315/192 |
| 2011/0062875 | A1 | 3/2011 | Altamura | |
| 2011/0074300 | A1 | 3/2011 | Hsu | |
| 2011/0148311 | A1* | 6/2011 | Neuman | H05B 33/0842 315/185 R |
| 2011/0210677 | A1 | 9/2011 | Hering et al. | |
| 2011/0228535 | A1 | 9/2011 | Shao | |
| 2011/0310601 | A1 | 12/2011 | Shao | |
| 2012/0007510 | A1 | 1/2012 | Horng | |
| 2012/0039070 | A1 | 2/2012 | Shen et al. | |
| 2012/0075863 | A1 | 3/2012 | Chen | |
| 2012/0275157 | A1 | 11/2012 | Hsu | |
| 2013/0078847 | A1 | 3/2013 | Chen | |
| 2013/0107514 | A1 | 5/2013 | McNabb et al. | |
| 2013/0140993 | A1 | 6/2013 | Buerrig | |
| 2013/0181232 | A1 | 7/2013 | Jeromerajan | |
| 2013/0249417 | A1 | 9/2013 | Verlinden | |
| 2013/0301246 | A1 | 11/2013 | Chen | |
| 2014/0055439 | A1 | 2/2014 | Lee | |
| 2014/0268869 | A1 | 9/2014 | Chen | |
| 2014/0334134 | A1 | 11/2014 | Loomis | |
| 2015/0008835 | A1 | 1/2015 | Sugiura et al. | |
| 2015/0029703 | A1 | 1/2015 | Chen | |
| 2015/0070878 | A1 | 3/2015 | Yu | |
| 2015/0078000 | A1 | 3/2015 | Chen | |
| 2015/0157159 | A1 | 6/2015 | Leung et al. | |
| 2016/0123566 | A1 | 5/2016 | Leung | |
| 2016/0183338 | A1 | 6/2016 | Loomis | |
| 2016/0186940 | A1 | 6/2016 | Del Castillo et al. | |
| 2016/0338171 | A1 | 11/2016 | Bhagat | |
| 2016/0341408 | A1 | 11/2016 | Altamura | |
| 2017/0023223 | A1 | 1/2017 | Tsai | |
| 2017/0038055 | A1 | 2/2017 | Daniels | |
| 2017/0108185 | A1 | 4/2017 | He | |
| 2017/0114967 | A1 | 4/2017 | Chen | |
| 2017/0295622 | A1 | 10/2017 | Harris | |
| 2017/0328527 | A1 | 11/2017 | Yang et al. | |
| 2017/0343170 | A1 | 11/2017 | Yu et al. | |
| 2018/0020519 | A1 | 1/2018 | Harris | |
| 2018/0020520 | A1 | 1/2018 | Harris | |
| 2018/0058648 | A1 | 3/2018 | Fang | |
| 2018/0084695 | P1 | 3/2018 | Lee | |
| 2018/0110101 | A1* | 4/2018 | Kottritsch | H05B 33/0824 |
| 2018/0172225 | A1 | 6/2018 | Zhao | |
| 2018/0172226 | A1 | 6/2018 | Zhao | |
| 2018/0231226 | A1* | 8/2018 | Koo | F21V 23/04 |
| 2018/0299084 | A1 | 10/2018 | Chien | |
| 2019/0053348 | A1 | 2/2019 | Harris | |
| 2019/0078767 | A1 | 3/2019 | Loomis | |
| 2019/0277458 | A1 | 9/2019 | Shao | |
| 2019/0335559 | A1 | 10/2019 | Shao | |

FOREIGN PATENT DOCUMENTS

| | | | |
|---|---|---|---|
| CN | 201121811 | Y | 9/2008 |
| CN | 201897194 | U | 7/2011 |
| CN | 201898147 | U | 7/2011 |
| CN | 201966240 | U | 9/2011 |
| CN | 202613183 | U | 12/2012 |
| CN | 203703878 | U | 7/2014 |
| DE | 8436328 | | 4/1985 |
| EP | 1 172 602 | A1 | 1/2002 |
| GB | 2 454 546 | A | 5/2009 |

OTHER PUBLICATIONS

American Wire Gauge Sizes and Properties Chart; https://www.solaris-shop-com/content/American%20Wire%20Guage%20Conductor%20Size%20Table.pdf (2009).

U.S. Appl. No. 16/298,935 filed Mar. 11, 2019, Inventor Shu Fa Shao (81 pgs.).

U.S. Appl. No. 16/397,419 filed Apr. 9, 2019, Inventor Shu Fa Shao (83 pgs.).

U.S. Appl. No. 16/219,657 filed Dec. 13, 2018, Inventor Johnny Chen (155 pages).

U.S. Appl. No. 16/547,377 filed Aug. 21, 2019, Inventor Shu Fa Shao (98 pages).

U.S. Appl. No. 16/653,514 filed Oct. 15, 2019, Inventor Shu Fa Shao (55 pages).

U.S. Appl. No. 16/185,467 filed Nov. 9, 2018, Inventor Shu-Fa Shao (189 pages).

* cited by examiner

PARALLEL CIRCUIT FOR LIGHT-EMITTING DIODES

CROSS-REFERENCE TO RELATED APPLICATIONS

The present application claims priority to Chinese Patent Application No. 201910052814.2, filed Jan. 21, 2019, which is incorporated herein by reference in its entirety.

FIELD OF THE INVENTION

This disclosure relates to a light string, and more particularly to a parallel circuit for light-emitting diodes.

BACKGROUND

Certain light strings that include a plurality of light sources directly soldered onto an electric cord at intervals, so as to form a sting-shaped illumination device without a lamp holder, are known in the art. A light string is generally as flexible as the electric cord is, such that the light string is easily arranged in any configuration to comply with requirements for special illumination or decoration.

In a light string, if the light sources are grouped into different groups to be controlled, for example, a group of the light sources flicker while the others remain on, light sources having a control integrated circuit (IC) chip are required, such as a light source having a control chip and an LED packaged together. Furthermore, the drive circuit has to be equipped with an encoding function to send encoding commands to individually switch each of the light sources.

Both the light source having a control IC and the drive circuit equipped with the encoding function are relatively expensive, and the overall cost and the retail price of the light string rises which put the light string at a competitive disadvantage.

SUMMARY

In view of the above problems, this disclosure provides a parallel circuit for light-emitting diodes to solve the above-mentioned problem.

The parallel circuit for light-emitting diodes according to this disclosure includes a first power wire, a second power wire, a first light-emitting diode (first LED), a second light-emitting diode (second LED), a switch, and a controller. The first LED has two ends respectively connected to the first power wire and the second power wire. The second LED and the switch are serially connected into a series circuit, and one end of the series circuit is connected to the first power wire, and the other end of the series circuit is connected to the second power wire. The switch changes between a conductive state and a non-conductive state according to a switching frequency. The controller is electrically connected to the first power wire and the second power wire. The controller supplies electric power to the first power wire and the second power wire, to generate a voltage difference between the first power wire and the second power wire.

In one or more embodiments, the controller repeatedly changes the electric power according to a switch cycle, to switch the voltage difference between a high voltage difference and zero voltage difference.

In one or more embodiments, the controller is configured to adjust a length of a half-cycle of the high voltage difference.

In one or more embodiments, the length of a half-cycle of the high voltage difference is larger than or equal to a period of the conductive state of the switch.

In one or more embodiments, a length of a half-cycle of the high voltage difference is smaller than a period of the conductive state of the switch.

In one or more embodiments, the controller is configured to adjust a length of a half-cycle of the high voltage difference.

According to embodiments of this disclosure, a plurality of LEDs are connected in parallel. Only a switch and a controller able to output variable pulse are required to group the LEDs into different groups to be controlled, so as to individually switch each group of the light sources flicker (selectively be powered on and off) or remain on. A complex control signal generator and LEDs having control IC are not required.

BRIEF DESCRIPTION OF THE DRAWINGS

The present invention will become more fully understood from the detailed description given herein below for illustration only, and is not intended to limit the present invention, wherein.

DETAILED DESCRIPTION

Figure 1:
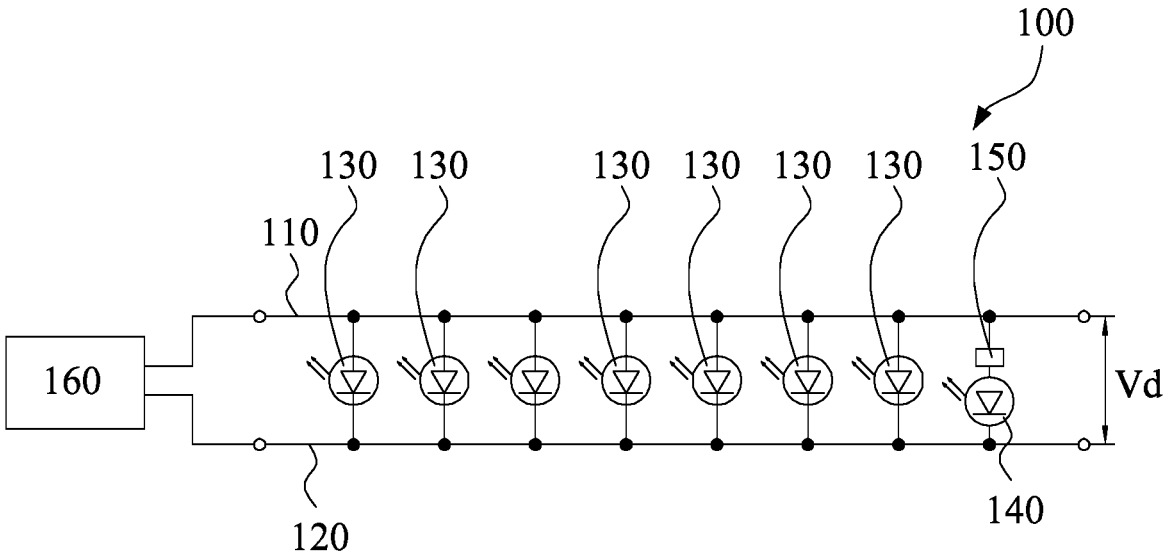
FIG. 1 is a circuit diagram of a parallel circuit with light-emitting diodes for a light string, according to a first embodiment of this disclosure.

Referring to FIG. 1, a parallel circuit 100 with a plurality of light-emitting diodes according to a first embodiment of this disclosure includes a first power wire 100, a second power wire 120, a plurality of first light-emitting diodes 130 (first LEDs 130), a second light-emitting diode 140 (second LED 140), a switch 150, and a controller 160.

As shown in FIG. 1, the first power wire 110 and the second power wire 120 are arranged in parallel. In an embodiment, the first and second power wires 110 and 120 are joined together by a one-piece insulating layer, also extending in parallel between the first and second power wires. Each of the first LEDs 130 has two ends respectively connected to the first power wire 110 and the second power wire 120. In other words, one end of each of the first LEDs 130, which in an embodiment is an anode end, is connected to power wire 110, and another end of each of the first LEDs 130, which in an embodiment is a cathode end, is connected to power wire 120. Furthermore, the forward-bias direction of each first LED 130 is from the first power wire 110 to the second power wire 120. That is, the positive electrode (anode) of each first LED 130 is connected to the first power wire 110, while the negative electrode (cathode) of the first LED 130 is connected to the second power wire 120.

As depicted in FIG. 1, the second LED 140 and the switch 150 are serially connected into a series circuit, which in an embodiment, forms a light-flickering circuit. One end of the series circuit is connected to the first power wire 110, and the other end of the series circuit is connected to the second power wire 120. Meanwhile, the forward-bias direction of the second LED 140 is from the first power wire 110 to the second power wire 120. That is, the positive electrode of the series circuit is directly or indirectly connected to the first power wire 110, and the negative electrode of the series circuit is directly or indirectly connected to the second power wire 120. In an embodiment, the switch 150 changes between a conductive state (closed; make) and a non-conductive state (open; break), which may be according to a switching frequency of the switch 150; in each switch cycle, the switch 150 changes into the conductive state and then changes into the non-conductive state. In an embodiment, switch 150 changes state, or opens and closes, based on an internal switching frequency fs of the switch. In an embodiment, the switching frequency is a predetermined frequency and is inherent to the switch 150. In an embodiment, for a single switch cycle, the duration or period that the switch is closed, a first "half cycle" may be the same as the duration of that the switch 150 is open, a second "half cycle." When a predetermined voltage, such as Vh is applied to the switch, the switch will cycle open and closed unless reset.

In an embodiment, and as explained further below, the switch 150 may have a predetermined or default period of the conductive state, Tc, or first half-cycle of the switch cycle, and may also have a predetermined default period of the non-conductive state, To, or the second half-cycle of the switch cycle. The predetermined default period of the conductive state, Tc, may be a maximum amount of time that the switch will stay in the conductive state for any given switch cycle; the predetermined default period of the non-conductive state, To, may be a maximum amount of time that the switch will stay in the non-conductive state for any given switch cycle. In an embodiment, the predetermined default periods of the conductive and non-conductive states may be equal in duration.

In an embodiment, the switch 150 will be "reset" based on an incoming voltage provided by the controller 160. In one such embodiment, and as explained above switch 150 closes/makes/conducts when an input voltage to switch 150 changes from low voltage, Vo to a high voltage Vh. As long as Vh is maintained, the switch 150 will cycle between conductive and non-conductive states. If the input voltage to the switch 150 is changed to a low voltage, such as Vo, which in an embodiment is zero volts, the switch 150 switches to the non-conductive state. When the input voltage is switched back to a high voltage, such as Vh, the switch 150 is reset and begins to conduct. In one such embodiment, the switch 150 makes on a rising voltage and breaks on a falling voltage. As such, the actual conductive period of time of the conductive state of the switch may be determined by the period of the input voltage signal or the predetermined conductive period of the switch as further explained below, whichever is less.

An example of the switch 150 is a control chip, which in an embodiment, is packaged with the second LED 140 to form a single light emitting component. In another embodiment, switch 150 is not packaged with the second LED, but rather, the series circuit comprises two electrically-connected chips, one for the switch 150 and one for the second LED 140.

In FIG. 1, a plurality of the first LEDs 130 and one series circuit (comprising switch 150 and second LED 140) are provided, and are connected between the first power wire 110 and the second power wire 120 in parallel to form a parallel circuit 100. In practice, the number of the first LEDs 130 and the number of the series circuit (second LED 140) are design options, and may vary depending on a desired number of LEDs, light string length, etc.

As shown in FIG. 1, a power controller 160 is electrically connected to the first power wire 110 and the second power wire 120. The controller 160 supplies electric power to the first power wire 110 and the second power wire 120, to generate a voltage difference Vd between the first power wire 110 and the second power wire 120.

In an embodiment, the controller 160 outputs DC power so as to maintain the voltage difference Vd at a fixed value. When the voltage difference Vd is generated, each of the first LEDs 130 remains on, while the second LED 140 flickers, i.e., is turned on and off, according to the switching frequency of the switch 150. In an embodiment, the switching frequency fs of the switch 150 is 1 Hz, such that the second LED 140 flickers by alternately turning on for 0.5 second and turning off for 0.5 second. This switching frequency of 1 Hz is much lower than the sampling rate of the human eye such that the human eye can observe the second LED 140 flickering. At this timing, it appears that among a plurality of LEDs one LED, LED 140, flickers, while the other LEDs, LEDs 130, remain on.

Figure 2:
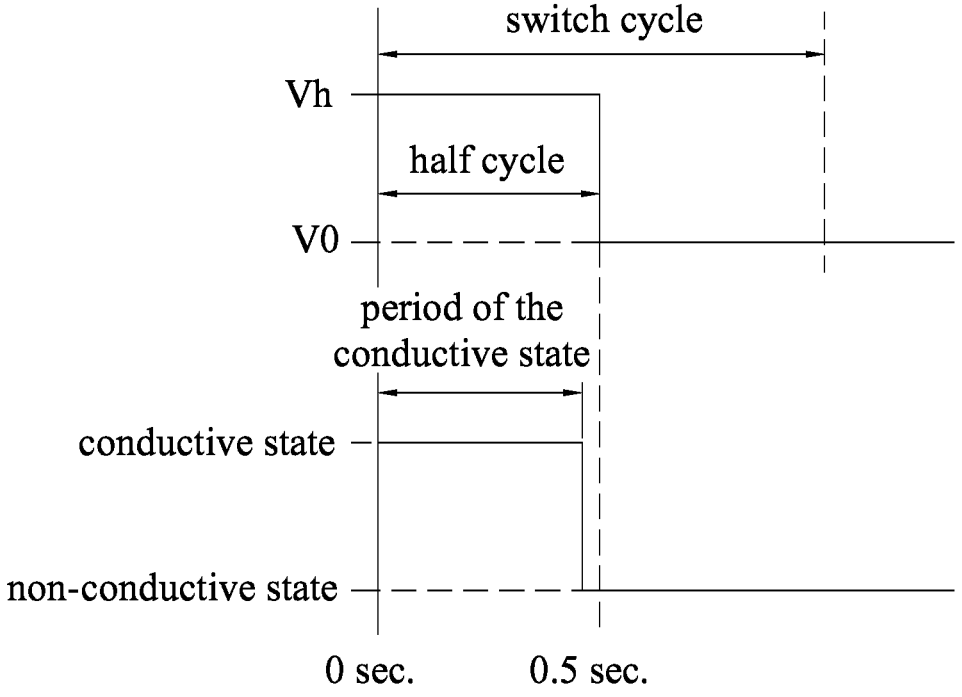
FIG. 2 is a comparative diagram showing the switch cycle of the controller and the half-cycle in a conductive state of the switch

As depicted in FIG. 2, in an embodiment, the controller 160 outputs a modulated electrical power sign which repeatedly changes the electric power thereby serving as a controller-implemented switch cycle, switching the voltage difference Vd between a high voltage difference Vh and zero voltage difference VO. This high voltage difference Vh must be higher than the turn-on voltage of each LEDs so as to cause the LEDs to operate and emit light. Furthermore, the controller, in an embodiment, is configured to adjust a length of a half-cycle of the high voltage difference Vh, or the period of the high-voltage portion of the power signal, and hence the switching frequency.

Referring to FIG. 2, controller 160 outputs voltage Vh for a half cycle that is equal to 0.5 seconds, which in this embodiment is slightly longer than the predetermined or default period Tc of the conductive state A of the switch 150. In such an embodiment, and generally speaking, when the length of the half-cycle of the high voltage difference Vh as output from the controller 160 is longer than or equal to the default period Tc of the conductive state of the switch 150, the first LEDs 130 will be turned on and off as the controller 160 output voltage Vh is turned on and off, i.e., LEDs 130 will "flicker", as will the second LED 140 as the voltage applied to it will also be turned on and off. When the half cycle of the voltage output of the controller 160 is the same as the conductive period Tc of the switch 150, the flickering frequency of the first LEDs 130 is identical to the flickering frequency of the second LED 140. If the half cycle of the output voltage Vh is longer, the LEDs 130 will flicker at the same frequency, though the on period for the first LEDs will be longer based on the half cycle of the output voltage. If the flickering frequency is much lower than the sampling rate of the human eye, the human eye can observe all the LEDs 130 and 140 flickering.

Figure 3:
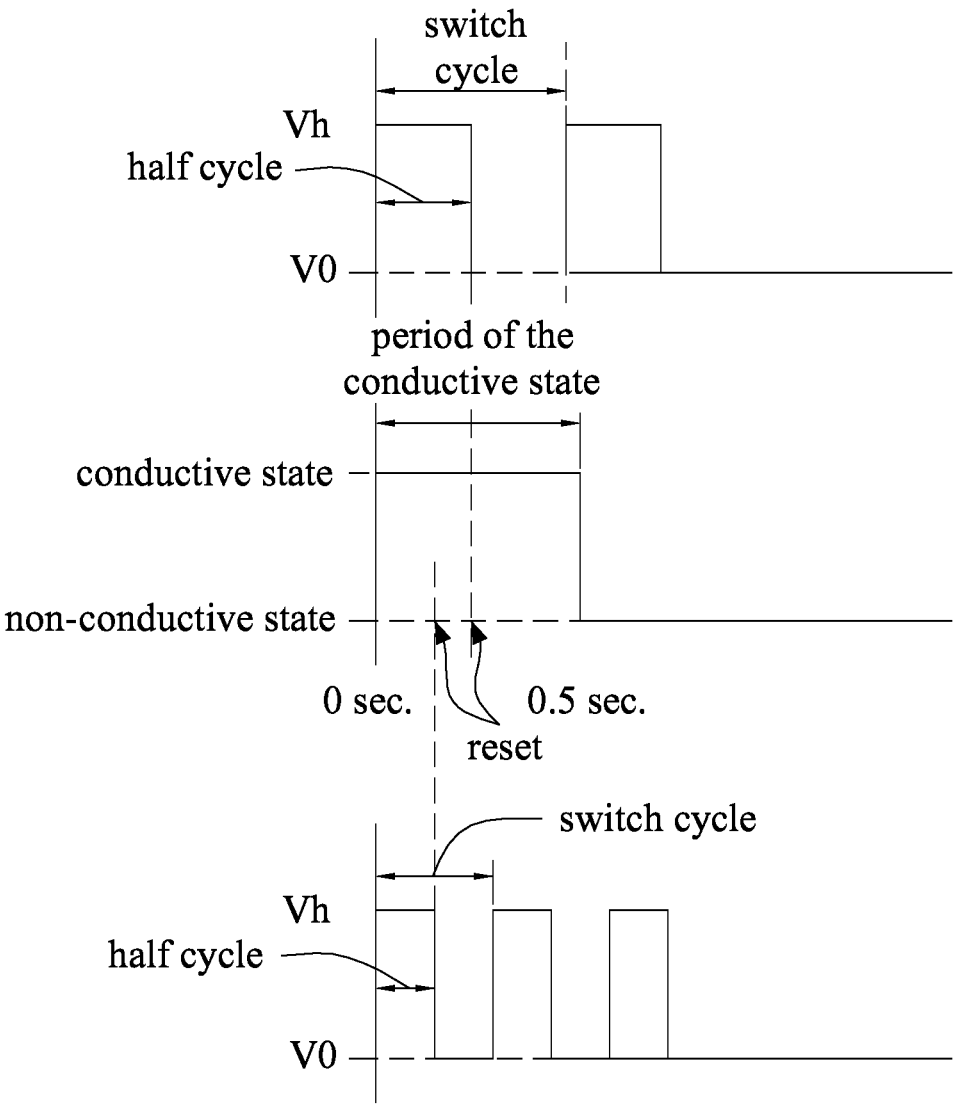
FIG. 3 is another comparative diagram showing the switch cycle of the controller and the half-cycle in conductive state of the switch

As depicted in FIG. 3, if the length of the half-cycle of the high voltage difference Vh is smaller than the period of the conductive state of the switch 150, the switch 150 is repeatedly reset and turns into the conductive state when the half-cycle of the high voltage difference Vh occurs. At this timing, if the switching frequency raises to a degree much higher than the sampling rate of the human eye to have persistence of vision, the human eye cannot observe all the second LEDs flicker. Instead, it appears to the human eye that all of the LEDs 130 and 140 remain on.

Providing that the switching frequency and the high voltage difference Vh are fixed, the length of the half cycle of the high voltage difference Vh takes a dominant role of the equivalent luminance of an LED. The equivalent luminance rises when the half cycle of the high voltage difference Vh becomes longer, and the equivalent luminance lowers when the half cycle of the high voltage difference Vh becomes shorter. Therefore, providing that the switching frequency and the high voltage difference Vh are fixed, changing the length of the half cycle of the high voltage difference Vh by time can have the LEDs to adjust LED brightness or light output.

Figure 4:
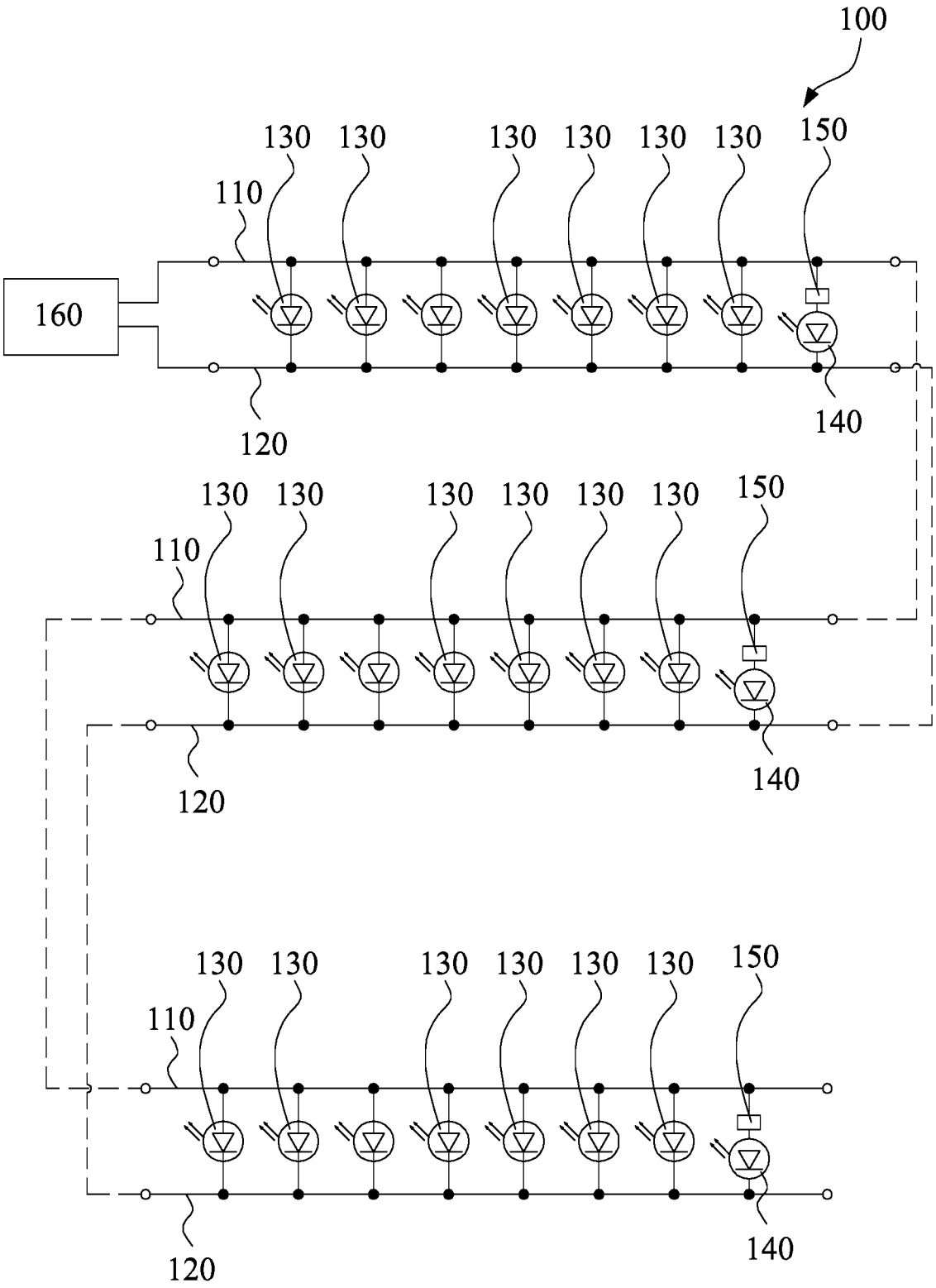
FIG. 4 is another circuit diagram of the parallel circuit with light-emitting diodes for a light string, according to the first embodiment of this disclosure.

As shown in FIG. 4, the number of parallel connected LEDs can be increased to substantially increase the number of LEDs in the parallel circuit 100. Since the LEDs are parallel connected, the output voltage of controller 160 does not needs to be changed for the added LEDs.

Figure 5:
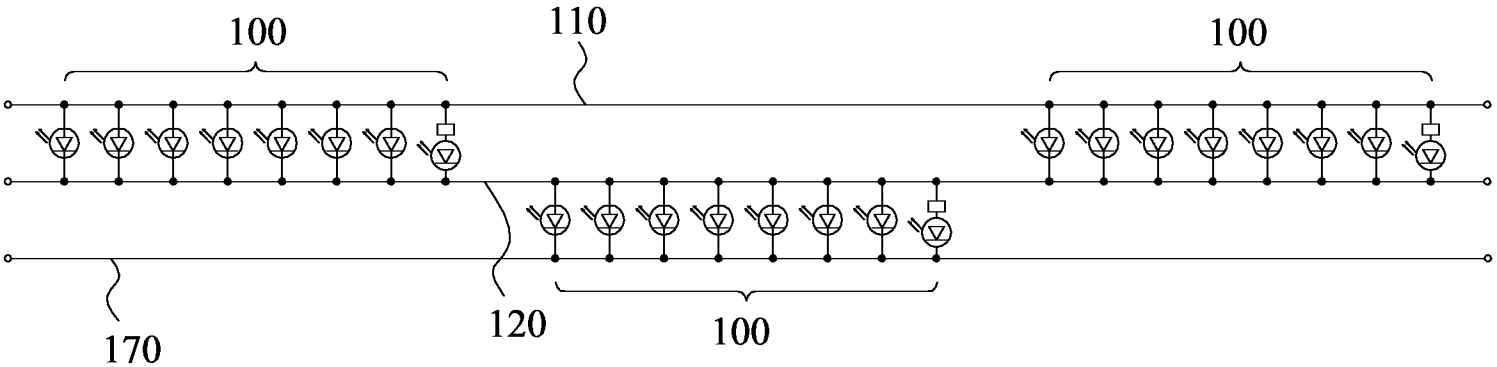
FIG. 5 is a circuit diagram of a parallel circuit with light-emitting diodes for a light string, according to a second embodiment of this disclosure.

Referring to FIG. 5, a parallel circuit 100 for light-emitting diodes according to a second embodiment of this disclosure results in a longer light string by expanding the parallel circuit 100 of the first embodiment.

As shown in FIG. 5, the parallel circuit for light-emitting diodes according to the second embodiment includes a first power wire 110, a second power wire 120, a third power wire 170, and a plurality of the parallel circuits 100 as shown in the first embodiment.

As shown in FIG. 5, in the second embodiment, the second power wire 120 and the third power wire 170 are equivalent to another set of the first power wire 110 and the second power wire 120, the one of more parallel circuits 100 as shown in the first embodiment are arranged between the second power wire 120 and the third power wire 170. Therefore, by changing the voltages of the first power wire 110, the second power wire 120, and the third power wire 170, and the high voltage differences Vh and zero voltage differences VO among different pairs of power wires can be individually changed, so as to perform grouped control.

Figure 6:
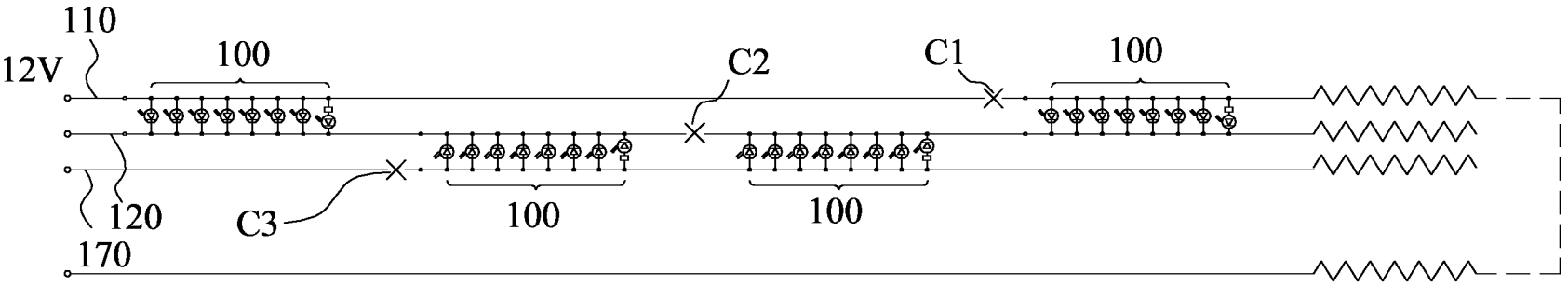
FIG. 6 is a circuit diagram of a parallel circuit with light-emitting diodes for a light string, according to a third embodiment of this disclosure.

Referring to FIG. 6, a parallel circuit 100 for light-emitting diodes according to a third embodiment of this disclosure is a longer light string by expanding the parallel circuit 100 of the first embodiment.

As shown in FIG. 6, the parallel circuit for light-emitting diodes according to the third embodiment includes a first power wire 110, a second power wire 120, a third power wire 170, and a plurality of the parallel circuits 100 as shown in the first embodiment.

As shown in FIG. 6, the parallel circuit 100 of the third embodiment further includes a third cut-off point C3, a second cut-off point C2 and a first cut-off point C1 to form the circuit. Each cut-off point C1, C2, C3 represents a discontinuity in the conductor or wire, such as the wire being "cut". The first power wire 110, the second power wire 120, and the third power wire 130 are arranged in parallel in a longitudinal light-string extension direction. In one example, each of the three power wires are single-conductor metal wires or stranded conductors; in an embodiment, the three power wires are joined together by a one piece insulating layer, also extending in the extension direction. The third cut-off point C3, the second cut-off point C2 and the first cut-off point C1 cut the third power wire 170, the second power wire 120, and the first power wire 110 in sequence, so as to divide the circuit into a plurality of circuit sections according to the third cut-off point C3, the second cut-off point C2 and the first cut-off point C1.

As shown in FIG. 6, in each section, one or more parallel circuits 100 are provided. These parallel circuits 100 are substantially connected in series, therefore, the voltage of the first power wire 110 has to be raised according to the number of the parallel circuits 100. For example, if each of the parallel circuit 100 is driven by a high voltage difference Vh of 3V and there are four parallel circuits 100 in FIG. 6, the voltage applied to the first power wire 110 has to be raised to 12V.

According to embodiments of this disclosure, a plurality of LEDs are connected in parallel. Only a switch 150 in each circuit, and a controller 160 able to output variable pulse are required to group the LEDs into different groups to be controlled, so as to individually switch each group of the light sources to flicker or remain on. A complex control signal generator and LEDs having control ICs are not required.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A parallel circuit for light-emitting diodes comprising:

a first power wire, a second power wire and a third power wire;

a first plurality of light-emitting diodes (LEDs), each of the LEDs of the first plurality of LEDs having two ends respectively connected to the first power wire and the second power wire;

a second LED and a switch, serially connected into a series circuit, wherein one end of the series circuit is connected to the first power wire, the other end of the series circuit is connected to the second power wire, and the switch changes between a conductive state and a non-conductive state according to a switching frequency;

a second plurality of LEDs, each ofthe second plurality of LEDs electrically connected to the others of the second plurality of LEDs in parallel, and another second LED electrically connected in series to another switch to form another series circuit, a first end of the other series circuit connected to the second wire and a second end of the other series circuited connected to the third wire, the other series circuit electrically connected to the second plurality of LEDs in parallel, and the first LEDs electrically connected to the second plurality of LEDs in series;

a controller, electrically configured to generate and control voltage differences between the first, second and third power wires, such that all of the first plurality of LEDs remain powered and emit light when the switch is in the conductive state and when the switch is in the non-conductive state, and all of the second plurality of LEDs remain powered and emit light when the other switch is in the conductive state and when the other switch is in the non-conductive state; and wherein the first, second and third wires are positioned substantially parallel to one another, and are connected to one another via a common insulating material.

2. The parallel circuit for LEDs as claimed in claim 1, wherein the controller repeatedly changes the electric power according to a controller-implemented switch cycle, to switch the voltage difference between a high voltage difference and zero voltage difference.

3. The parallel circuit for LEDs as claimed in claim 2, wherein the controller is configured to adjust a length of a half-cycle of the high voltage difference.

4. The parallel circuit for LEDs as claimed in claim 3, wherein the length of a half-cycle of the high voltage difference is larger than or equal to a period of the conductive state of the switch.

5. The parallel circuit for LEDs as claimed in claim 2, wherein a length of a half-cycle of the high voltage difference is smaller than a period of the conductive state of the switch.

6. The parallel circuit for LEDs as claimed in claim 5, wherein the controller is configured to adjust the length of the half-cycle of the high voltage difference.

7. The parallel circuit for LEDs as claimed in claim 1, further comprising a third plurality of LEDs, each LED of the third plurality of LEDs electrically connected to the others of the third plurality of LEDs in parallel, and a third LED electrically connected in series to a third switch to form a third series circuit, the third series circuit electrically connected in parallel with the third plurality of LEDs, and wherein all of the third plurality of LEDs remain powered and emit light when the third switch is in a conductive state and when the third switch is in a non-conductive state; and a fourth plurality of LEDs, each LED of the fourth plurality of LEDs electrically connected to the others of the fourth plurality of LEDs in parallel, and a fourth LED electrically connected in series to a fourth switch to form a fourth series circuit, the fourth series circuit electrically connected in parallel with the fourth plurality of LEDs and wherein all of the fourth plurality of LEDs remain powered and emit light when the fourth switch is in a conductive state and when the fourth switch is in a non-conductive state; and wherein the third plurality of LEDs is in electrically connected in series with the second plurality of LEDs and the fourth plurality of LEDs is electrically connected in series with the third plurality of LEDs.

8. The parallel circuit for LEDs as claimed in claim 1, wherein the controller is configured to supply electrical power to the first and second wires in the form of a modulated power signal that repeatedly switches between a first voltage and a second voltage, a difference between the first voltage and the second voltage sufficient to cause the first plurality of LEDs to emit light.

9. A light string with selective switching control, comprising:

a first power wire;

a second power wire;

a third power wire;

a first plurality of light-emitting diodes (LEDs), each of the first plurality of LEDs having an anode end and a cathode end, the anode end electrically connected to the first power wire, and the cathode end electrically connected to the second power wire, such that the LEDs of the first plurality of LEDs are electrically connect in parallel;

a flickering circuit comprised of a switch electrically connected in series to a second LED, a first end of the switch electrically connected to the first power wire, a second end of the switch electrically connected to an anode end of the second LED, and a cathode end of the second LED electrically connected to the second power wire, the flickering circuit connected in parallel to the first plurality of LEDs, the switch configured to switch between a conductive state for a predetermined conductive period of time, and a non-conductive state for a predetermined non-conductive period of time;

a second plurality of LEDs, each of the LEDs of the second plurality of LEDs electrically connected to the others of the second plurality of LEDs in parallel, and another second LED electrically connected in series to another switch to form another flickering circuit, a first end of the other flickering circuit connected to the second wire and a second end of the other series circuited connected to the third wire, the other flickering circuit electrically connected to the second plurality of LEDs in parallel, and the first plurality of LEDs electrically connected to the second plurality of LEDs in series; and a controller configured to selectively control modulation of electrical power to the first, second and third power wires, including controlling generation of a modulated power signal defining a repeating switch cycle comprising a first voltage signal portion and a second voltage signal portion;

wherein an actual conductive period of time of the switch is a lesser of a predetermined conductive period of the switch and a period of the first voltage portion of the power signal, and wherein all of the first plurality of LEDs remain powered and emit light when the switch is in the conductive state and when the switch is in the non-conductive state.

10. The light string of claim 9, wherein the second voltage signal portion is zero volts, and the first voltage signal portion is higher than the second voltage signal portion.

11. The light string of claim 9, wherein the controller is configurable to adjust the power signal such that the period of the of the first-voltage portion of the power signal is less than, equal to, or greater than, the predetermined conductive period of the switch.

12. The light string of claim 11, wherein the period of the first-voltage portion of the power signal is longer than the predetermined conductive period of the switch, such that the actual period of the switch conductive state is equal to the predetermined conductive period of the switch.

13. The light string of claim 11, wherein the period of the first-voltage portion of the power signal is shorter than the predetermined conductive period of the switch, such that the actual period of the switch conductive state is equal to the period of the first-voltage portion of the power signal.

14. The light string of claim 9, wherein the controller is configured to adjust the length of the half-cycle of the high voltage difference.

15. The light string of claim 9, further comprising:

a third plurality of LEDs, each LED of the third plurality of LEDs electrically connected to the others of the third plurality of LEDs in parallel, and a third LED electrically connected in series to a third switch to form a third flickering circuit, the third flickering circuit electrically connected in parallel with the third plurality of LEDs and wherein all of the third plurality of LEDs remain powered and emit light when the third switch is in a conductive state and when the third switch is in a non-conductive state, and a fourth plurality of LEDs, each LED of the fourth plurality of LEDs electrically connected to the others of the fourth plurality of LEDs in parallel, and a fourth LED electrically connected in series to a fourth switch to form a fourth flickering circuit, the fourth flickering circuit electrically connected in parallel with the fourth plurality of LEDs and wherein all of the fourth plurality of LEDs remain powered and emit light when the fourth switch is in a conductive state and when the fourth switch is in a non-conductive state; and wherein the third plurality of LEDs is in electrically connected in series with the second plurality of LEDs and the fourth plurality of LEDs is electrically connected in series with the third plurality of LEDs.

16. The light string of claim 9, wherein the first wire and the second wire are joined to one another by an insulating portion between the first wire and the second wire.

17. The light string of claim 9, wherein the power signal is modulated at a frequency that causes the first plurality of LEDs and the second LED to turn on and off at a frequency that is not perceptible to a human eye, such that the first plurality of LEDs and the second LED are perceived to be constantly on.

18. The light string of claim 9, wherein the first voltage signal portion is a voltage that is greater than an operating voltage of any of the LEDs of the first plurality of LEDs and the second LED.

19. A light-emitting diode (LED) circuit comprising:

a first power wire, a second power wire, and a third power wire;

a first plurality of light-emitting diodes (LEDs), each of the LEDs of the first plurality of LEDs having two ends respectively connected to the first power wire and the second power wire;

a second LED and a switch serially connected into a series circuit, wherein one end of the series circuit is connected to the first power wire, the other end of the series circuit is connected to the second power wire, and the switch changes between a conductive state and a non-conductive state according to a switching frequency;

a second plurality of LEDs, each of the second plurality of LEDs electrically connected to the others of the second plurality of LEDs in parallel, and another second LED electrically connected in series to another switch to form another series circuit, a first end of the other series circuit connected to the second wire and a second end of the other series circuited connected to the third wire, the other series circuit electrically connected to the second plurality of LEDs in parallel, and the first LEDs electrically connected to the second plurality of LEDs in series; and a controller, electrically configured to generate and control voltage differences between the first, second and third power wires.

20. The LED circuit as claimed in claim 19, wherein the controller repeatedly changes the electric power according to a controller-implemented switch cycle, to switch a voltage difference between a high voltage difference and zero or negative voltage difference.

21. The LED circuit as claimed in claim 19, wherein anodes of the first plurality of LEDs are connected to the first power wire, cathodes of the first plurality of LEDs are connected to the second power wire, anodes of the second plurality of LEDs are connected to the second power wire, and cathodes of the second plurality of LEDs are connected to the third power wire.

22. The LED circuit as claimed in claim 19, wherein anodes of the first plurality of LEDs are connected to the first power wire, cathodes of the first plurality of LEDs are connected to the second power wire, cathodes of the second plurality of LEDs are connected to the second power wire, and anodes of the second plurality of LEDs are connected to the third power wire.

23. The LED circuit as claim in claim 22, wherein at least one of the first power wire, the second power wire, and the third power wire defines a cut-off point that causes an electrical discontinuity in the at least one of the first power wire, the second power wire, and the third power wire.

24. The LED circuit as claim 19, wherein all of the first plurality of LEDs remain powered and emit light when the switch is in a conductive state and when the switch is in a non-conductive state.

25. The LED circuit as claimed in claim 19, wherein the first and second power wires are joined together by a one-piece insulating layer.

* * * * *